US008758053B2

(12) United States Patent
Paynter et al.

(10) Patent No.: US 8,758,053 B2
(45) **Date of Patent: *Jun. 24, 2014**

(54) LOW PIM COAXIAL CONNECTOR

(75) Inventors: Jeffrey Paynter, Momence, IN (US); Nahid Islam, Westmont, IL (US)

(73) Assignee: Andrew LLC, Hickory, NC (US)

( * ) Notice: Subject to any disclaimer, the term of this patent is extended or adjusted under 35 U.S.C. 154(b) by 247 days.

This patent is subject to a terminal disclaimer.

(21) Appl. No.: 13/433,635

(22) Filed: Mar. 29, 2012

(65) Prior Publication Data

US 2012/0184135 A1 Jul. 19, 2012

Related U.S. Application Data

(63) Continuation-in-part of application No. 12/795,013, filed on Jun. 7, 2010, now Pat. No. 8,157,587.

(51) Int. Cl.
*H01R 9/05* (2006.01)

(52) U.S. Cl.
USPC ..... 439/584; 439/472; 439/454

(58) Field of Classification Search
USPC ..... 439/452, 454, 455, 470, 472, 583, 584
See application file for complete search history.

(56) References Cited

U.S. PATENT DOCUMENTS

| | | | | |
|---|---|---|---|---|
| 3,110,756 | A | 11/1963 | Genung et al. | |
| 3,778,535 | A | 12/1973 | Forney, Jr. | |
| 4,995,832 | A | 2/1991 | Thommen et al. | |
| 5,267,877 | A | 12/1993 | Scannelli | |
| 5,322,454 | A | 6/1994 | Thommen | |
| 5,795,188 | A * | 8/1998 | Harwath | 439/583 |
| 6,080,015 | A * | 6/2000 | Andreescu | 439/584 |
| 6,210,222 | B1 | 4/2001 | Langham et al. | |
| 6,217,384 | B1 | 4/2001 | Strasser et al. | |
| 6,471,545 | B1 | 10/2002 | Hosler, Sr. | |
| 7,077,699 | B2 | 7/2006 | Islam et al. | |
| 7,261,581 | B2 | 8/2007 | Henningsen | |
| 7,335,059 | B2 | 2/2008 | Vaccaro | |
| 7,347,729 | B2 | 3/2008 | Thomas et al. | |
| 7,588,460 | B2 | 9/2009 | Malloy et al. | |
| 7,635,283 | B1 * | 12/2009 | Islam | 439/583 |
| 7,731,529 | B1 * | 6/2010 | Islam | 439/583 |

(Continued)

FOREIGN PATENT DOCUMENTS

WO 2004/055943 7/2004

OTHER PUBLICATIONS

European Search Report, related application EP 11 16 5434, issued Aug. 12, 2011 by European Patent Office, Netherlands.

*Primary Examiner* — James Harvey
(74) *Attorney, Agent, or Firm* — Babcock IP, PLLC

(57) ABSTRACT

A coaxial connector is provided with a connector body coupled to a connector coupling body. A slip ring is provided within a bore of the connector coupling body. An outer conductor groove of the connector body is open to a cable end of the connector body. A contact surface is provided on an inner sidewall of the outer conductor groove. A spring contact is provided between the slip ring and the connector body and a stabilizing assembly is coupled to a cable end of the connector coupling body. The axial advance of the connector coupling body towards the connector body drives the slip ring against the coil spring to clamp a leading edge of the outer conductor inserted into the outer conductor groove against the contact surface. The stabilizing assembly grips a jacket of the coaxial cable, stabilizing the interconnection. Methods of manufacture and interconnection are also disclosed.

20 Claims, 17 Drawing Sheets

(56) References Cited

U.S. PATENT DOCUMENTS

| | | | | |
|---|---|---|---|---|
| 7,824,215 | B2 * | 11/2010 | Islam et al. | 439/578 |
| 7,918,687 | B2 | 4/2011 | Paynter et al. | |
| 7,927,135 | B1 | 4/2011 | Wlos | |
| 8,393,919 | B2 * | 3/2013 | Islam et al. | 439/584 |
| 8,454,384 | B2 * | 6/2013 | Islam et al. | 439/583 |
| 8,460,031 | B2 * | 6/2013 | Paynter et al. | 439/584 |
| 2005/0118853 | A1 | 6/2005 | Stark et al. | |
| 2012/0064768 | A1 * | 3/2012 | Islam et al. | 439/585 |

* cited by examiner

LOW PIM COAXIAL CONNECTOR

BACKGROUND

1. Field of the Invention

This invention relates to electrical cable connectors. More particularly, the invention relates to a coaxial connector with improved passive intermodulation distortion (PIM) electrical performance and mechanical interconnection characteristics.

2. Description of Related Art

Coaxial cable connectors are used, for example, in communication systems requiring a high level of precision and reliability.

To create a secure mechanical and optimized electrical interconnection between the cable and the connector, it is desirable to have generally uniform, circumferential contact between a leading edge of the coaxial cable outer conductor and the connector body. A flared end of the outer conductor may be clamped against an annular wedge surface of the connector body, via a coupling body. Representative of this technology is commonly owned U.S. Pat. No. 5,795,188 issued Aug. 18, 1998 to Harwath.

Alternative forms of connector to cable end electro-mechanical interconnection include various grip surface arrangements of the connector which contact and grip the inner and/or outer conductor of the coaxial cable.

During systems installation, rotational forces may be applied to the installed connector, for example as the attached coaxial cable is routed towards the next interconnection, maneuvered into position and/or curved for alignment with cable supports and/or retaining hangers. Rotation of the coaxial cable and coaxial connector with respect to each other may damage the connector, the cable and/or the integrity of the cable/connector inter-connection. Further, once installed, twisting, bending and/or vibration applied to the interconnection over time may degrade the connector to cable interconnection and/or introduce PIM.

Prior coaxial connectors typically utilize a coupling and/or back body as a driving means for clamp and/or grip interconnection mechanisms of the connector and/or as an ease of assembly means for enabling easy insertion of internal elements within the connector, such as seals and/or electrical contact elements. Couplings and/or back bodies may also include elastomeric environmental seals compressed into a sealing configuration against the coaxial cable via a compression action with respect to the connector body. Representative of this technology is commonly owned U.S. Pat. No. 7,077,699 issued Jul. 18, 2006 to Islam et al. Although an environmental seal compressed to extend radially inward into contact with a jacket of a coaxial cable may provide a stabilizing effect upon the coaxial connector, the environmental seal is typically formed from an elastic material to enable an elastic sealing deformation contact against the jacket. Therefore, any stabilizing effect obtained from the environmental seal is limited.

Prior coaxial connectors are typically configured for interconnection with a particular coaxial cable, for example a smooth outer conductor coaxial cable or a corrugated outer conductor coaxial cable, thereby providing dedicated coaxial connector models for each type of coaxial cable increase design, manufacturing and inventory costs.

Competition in the coaxial cable connector market has focused attention on improving electrical performance and minimization of overall costs, including materials costs, training requirements for installation personnel, reduction of dedicated installation tooling and the total number of required installation steps and/or operations.

Therefore, it is an object of the invention to provide a coaxial connector that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventor has recognized that movement and/or skewing of alignment between the connector and coaxial cable may generate unacceptable levels of PIM and/or otherwise compromise the electromechanical interconnection, for example as contact surfaces shift relative to one another and/or less than uniform circumferential contact occurs between the electrical contacting elements of the connector and the inner and/or outer conductors.

Figure 1:
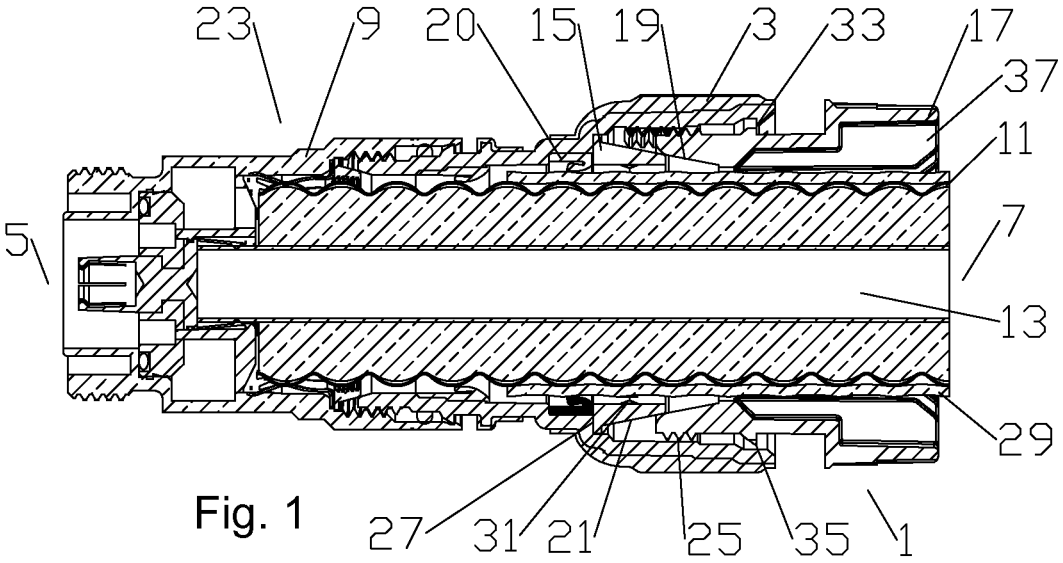
FIG. 1 is a schematic cross-section side view of a first exemplary embodiment of an insertion coupling type coaxial connector with stabilizing assembly, ready for application of the stabilizing contact upon the coaxial cable via the stabilizing assembly.
Figure 2:
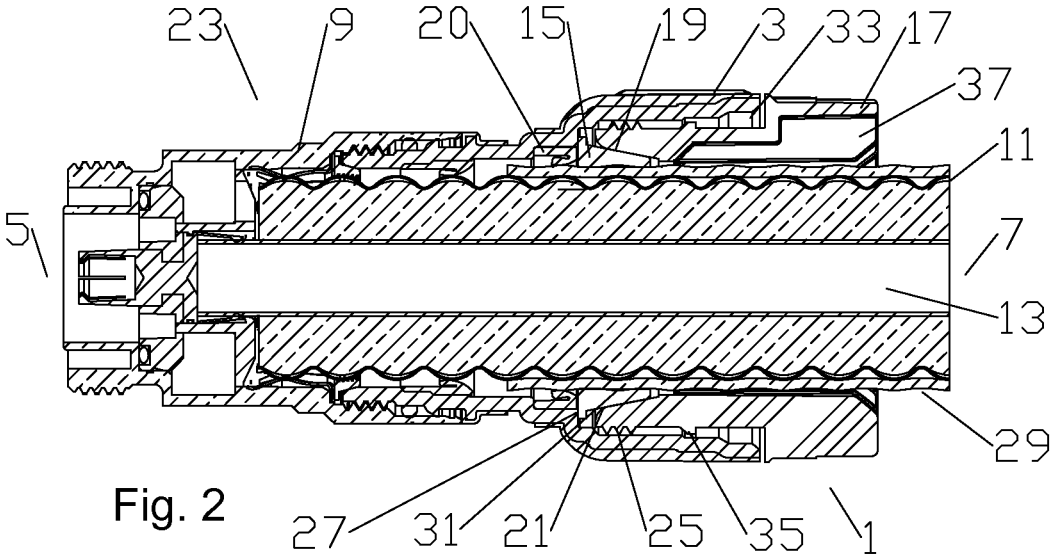
FIG. 2 is a view of the connector of FIG. 1, with the stabilizing assembly applying the stabilizing contact to the coaxial cable.
Figure 3:
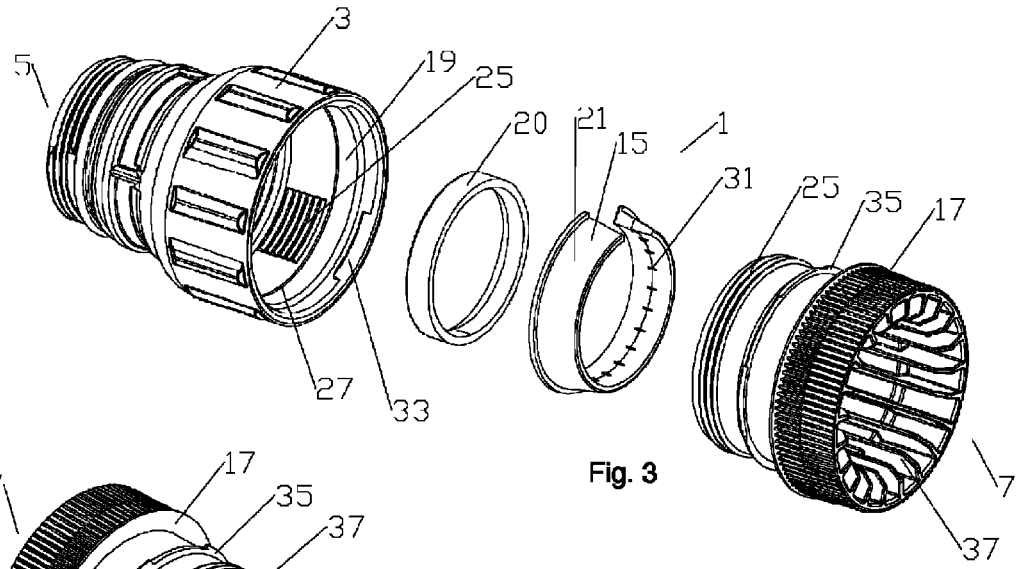
FIG. 3 is a schematic exploded angled isometric view of the stabilizing assembly of FIG. 1.
Figure 4:
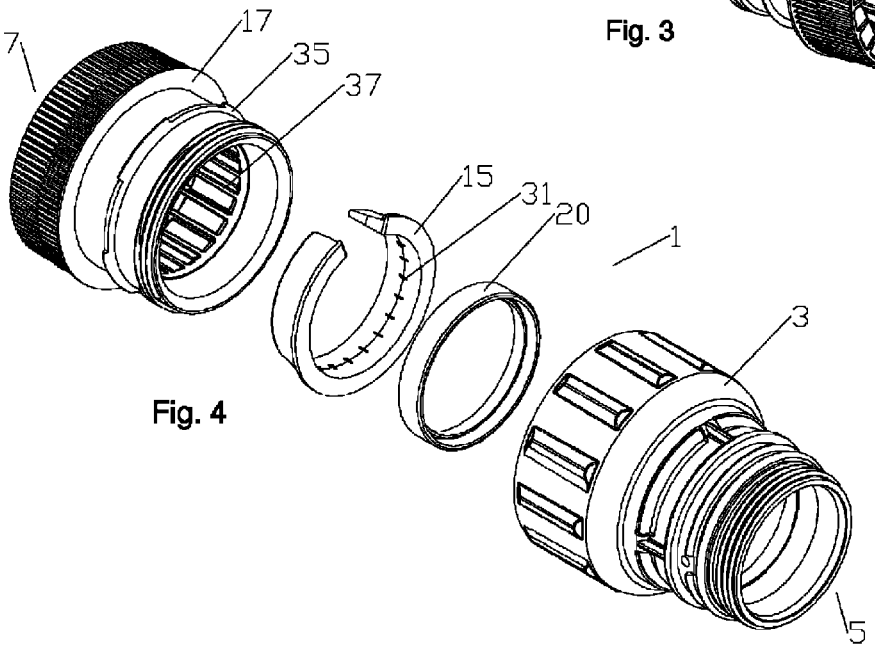
FIG. 4 is a reverse angle view of the assembly of FIG. 3.

A stabilizing assembly 1 with a connector to cable interconnection stabilizing functionality is demonstrated in FIGS. 1-4. As best shown in FIGS. 3 and 4, the stabilizing assembly 1 includes a coupling body 3 dimensioned to couple at a connector end 5 of the coupling body 3 with a cable end 7 of a coaxial connector body 9.

One skilled in the art will appreciate that connector end 5 and cable end 7 are applied herein as identifiers for respective ends of both the coaxial connector 10 and the stabilizing assembly 1 and also of discrete elements of both described herein, to identify same and their respective interconnecting surfaces according to their alignment along a longitudinal axis of the coaxial connector between a connector end 5 and a cable end 7.

The coupling body 3 may be configured to perform connector functions in concert with the connector body 9, such as electro-mechanical interconnection with an outer conductor 11 of a coaxial cable 13 and also environmental sealing of the electro-mechanical interconnection, for example by elastomeric sealing gasket(s) 20 seated in a gasket shoulder or annular groove of the coupling body inner diameter. Details of these functions and the associated structures of the coupling body 3 are dependent upon the type of coaxial connector 10 that the stabilizing assembly 1 is applied to.

A jacket grip 15 of rigid material, for example acrylic or polycarbonate plastics, is retained between the coupling body 3 and a stabilizing body 17 coupled to a cable end 7 of the coupling body 3. The jacket grip 15 may be c-shaped, dimensioned for fit within the stabilizing assembly 1 and also to enable insertion of the coaxial cable 13 therethrough during interconnection of coaxial connector 10 and coaxial cable 13. An outer diameter of the jacket grip 15 has a contact surface 19 abutting an inner diameter annular wedge surface 21 of the stabilizing body 17, the wedge surface 21 provided with a taper between a maximum diameter proximate a connector end 5 of the jacket grip 15 and a minimum diameter proximate a cable end 7 of the wedge surface 21.

As the stabilizing body 17 is advanced axially towards the coupling body 3, for example via threads 25 or alternatively an axial compression interference fit, the angled contact surface 19 of the jacket grip 15 contacts the wedge surface 21 of the stabilizing body 17, driving the jacket grip 15 against an inward projecting shoulder 27 of the coupling body 3 and then radially inward against the jacket 29 of the coaxial cable 13. As the inner diameter of the jacket grip 15 engages the jacket 29, a secure stabilizing contact is established, distributed across a width of the jacket grip 15, between the stabilizing assembly 1 and the attached connector body 9. By applying a width of the jacket grip 15, for example at least as wide as a corrugation period of a desired coaxial cable and/or at least twice as wide as a cross-sectional height of the jacket grip 15, chances of coaxial cable deformation resulting from the stabilizing contact are reduced. Because the jacket grip 15 is formed from a rigid non-compressible material and the contacts between the jacket grip 15 and the coupling body 3 and stabilizing body 17 are hard points, once the jacket 29 has deformed, if applicable, from contact therewith, the stabilizing contact is essentially rigid.

The stabilizing contact may be enhanced with respect to a longitudinal axis direction, to also improve the mechanical tear off strength of the interconnection between the coaxial connector 10 and coaxial cable 13, by applying a plurality of inward projecting protrusion(s) 31 to the inner diameter of the jacket grip 15. Further, the inward projecting protrusion(s) 31 may improve an anti-rotation coaxial connector 10 to coaxial cable 13 characteristic of the stabilizing contact.

As best shown in FIG. 1, to retain the stabilizing body 17 coupled to the coupling body 3 pre-assembled but not axially tightened, a retention mechanism such as a retaining lip 33 of the coupling body 3 and a corresponding retention burr 35 of the stabilizing body 17 may be applied projecting outward and inward respectively. The retaining lip 33 and the retention burr 35 co-operate to snap engage and retain one to the other when an initial axial position has been reached. Thereby, the jacket grip 15 and any applicable environmental seals may be pre-mounted within the stabilizing assembly 1 so that an installer has no initial assembly operations to perform and/or to ensure that these internal elements are not lost prior to interconnection, simplifying interconnection of the coaxial connector 10 with the coaxial cable 13.

The coupling body 3, jacket grip 15 and stabilizing body 17 may be cost effectively manufactured via injection molding, for example of polymeric material. The injection molding may be further optimized with respect to materials consumption and reduction of molding defects such as warp and sink by forming areas of the stabilizing body 17 with a plurality of inward extending support fin(s) 37, rather than a conventional solid configuration with significant material thickness areas where material strength requirements of the structure are reduced. Further, to simplify mold design and mold separation mechanics, thread(s) 25 and/or inward/outward projecting retaining lip 33 and/or retention burr 35 may be applied as arc segments rather than continuous annular features. Thereby, upon rotation of the respective mold portion and/or the molded component, axial mold separation is enabled.

In use, the coaxial connector 10 is interconnected with the coaxial cable 13 according to the selected electro-mechanical configuration of the connector body 9 and connector end 5 of the coupling body 3, for example as shown in FIG. 1. Once the electro-mechanical interconnection is completed, the connector end 5 of the stabilizing body 17 is advanced towards the cable end 7 of the coupling body 3, in the present example by threading the threads 25 together, driving the jacket grip 15 radially inward into stabilizing contact with the jacket 29, as shown in FIG. 2.

Because the stabilizing assembly 1 is separate from the connector body 9, benefits of the stabilizing assembly 1 may be applied to existing connector families with only minimal redesign of the coupling body 3, to obtain the benefits of the stabilizing contact/cable support generated thereby.

Figure 5:
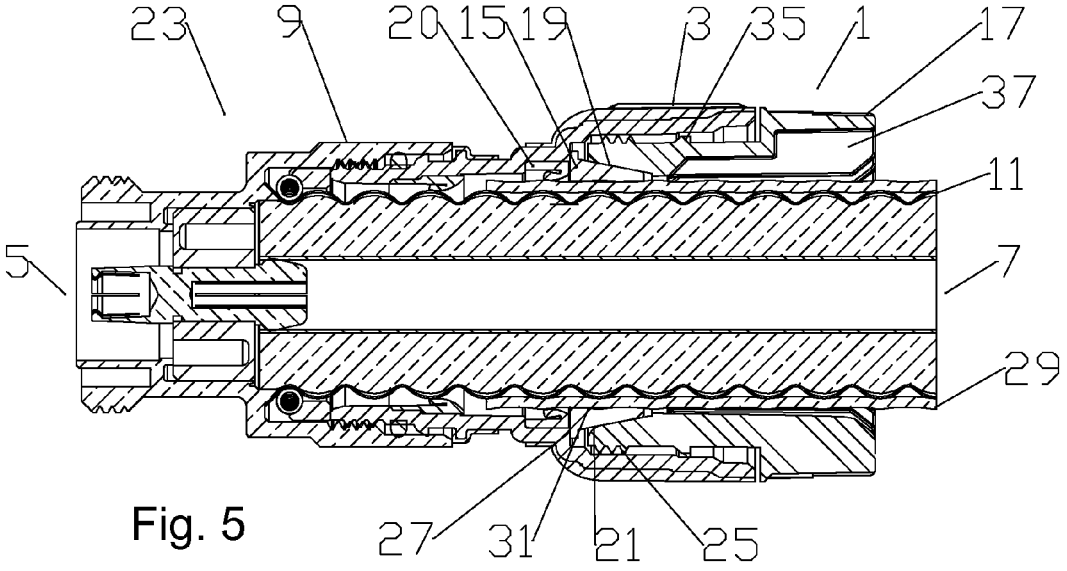
FIG. 5 is a schematic cross-section side view of the first embodiment of a stabilizing assembly demonstrated mated with an alternative coaxial connector configuration, a conventional outer conductor leading edge clamp type coaxial connector.

FIG. 5 demonstrates a stabilizing assembly 1 applied to a conventional coaxial connector configuration in which the end of the outer conductor is flared and clamped against a conical contact surface 23 by a spring contact 43 as the coupling body 3 is axially advanced upon the connector body 9. To interconnect the coaxial connector 10 with a coaxial cable 13, the connector assembly must be disassembled and the spring contact 43, slip ring 45 and coupling body 3 with stabilizing assembly elements are each fitted upon the end of the coaxial cable 13 before a flaring operation is applied to the leading edge of the outer conductor 11 and the coaxial connector 10 is reassembled.

FIGS. 6-10 show a further embodiment of a coaxial connector with a stabilizing assembly 1 snap fit between a cable end 7 of the connector coupling body 39 and a connector end 5 of the coupling body 3 of the stabilizing assembly 1. Thereby, the stabilizing assembly 1 is entirely separate from the electro-mechanical attachment between the connector body 9 and/or connector coupling body 39 and the outer conductor 11 of the coaxial cable 13. Because the interconnection between the stabilizing assembly 1 and the jacket 29 is separate, the potential for PIM generation due to degradation of the coaxial connector and outer conductor electro-mechanical interconnection due to movement during interconnection of the stabilizing assembly 1 may be reduced. Further, the connector coupling body 39 may be formed from metal, enabling increased clamping forces to be applied to the electro-mechanical interconnection and tool flats on the connector coupling body 39 with greater resistance to wrench wear.

Figure 6:
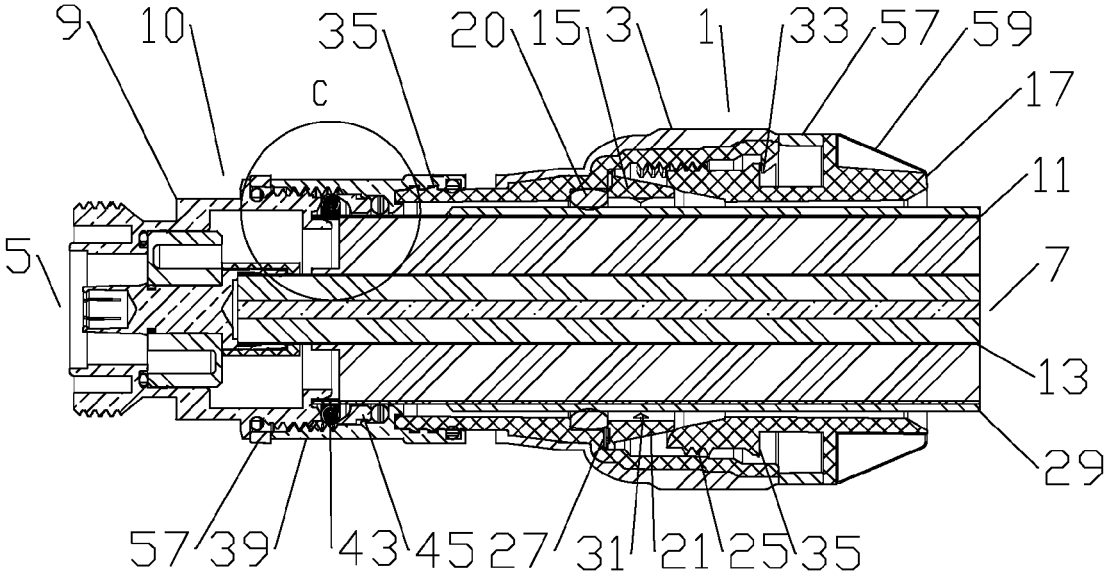
FIG. 6 is a schematic cross-section side view of a second embodiment of a stabilizing assembly mated with another alternative coaxial connector configuration, an insertion type outer conductor leading edge radial clamp type coaxial connector, demonstrated with a smooth sidewall outer conductor coaxial cable in the coaxial cable insertion configuration.
Figure 7:
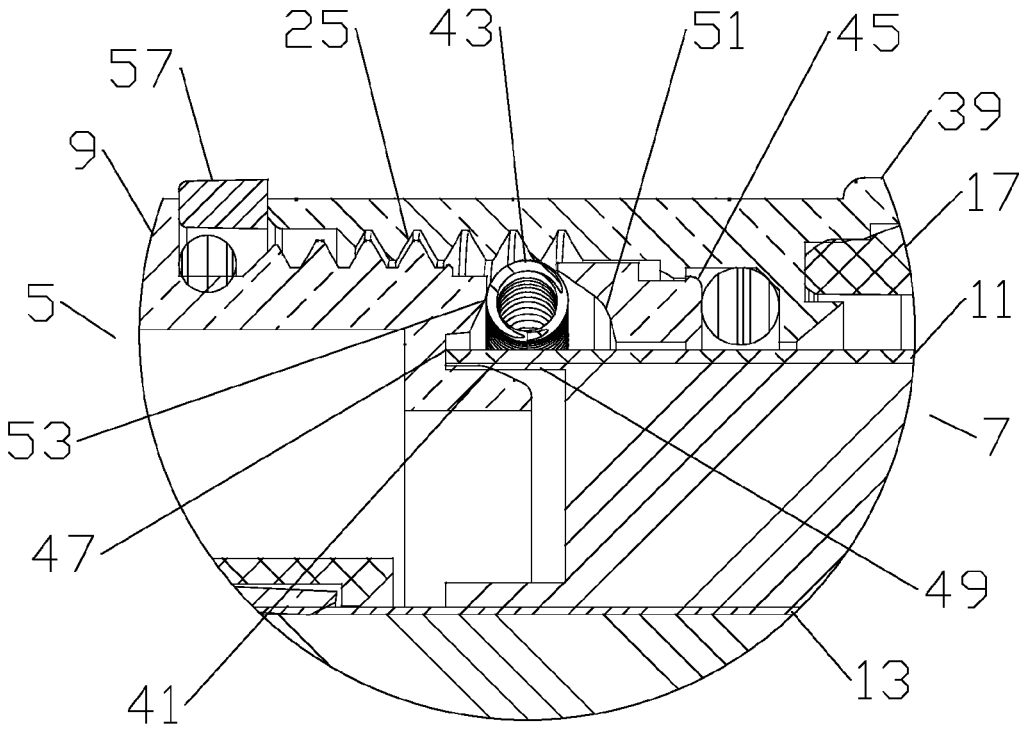
FIG. 7 is a close-up view of area C of FIG. 6.
Figure 8:
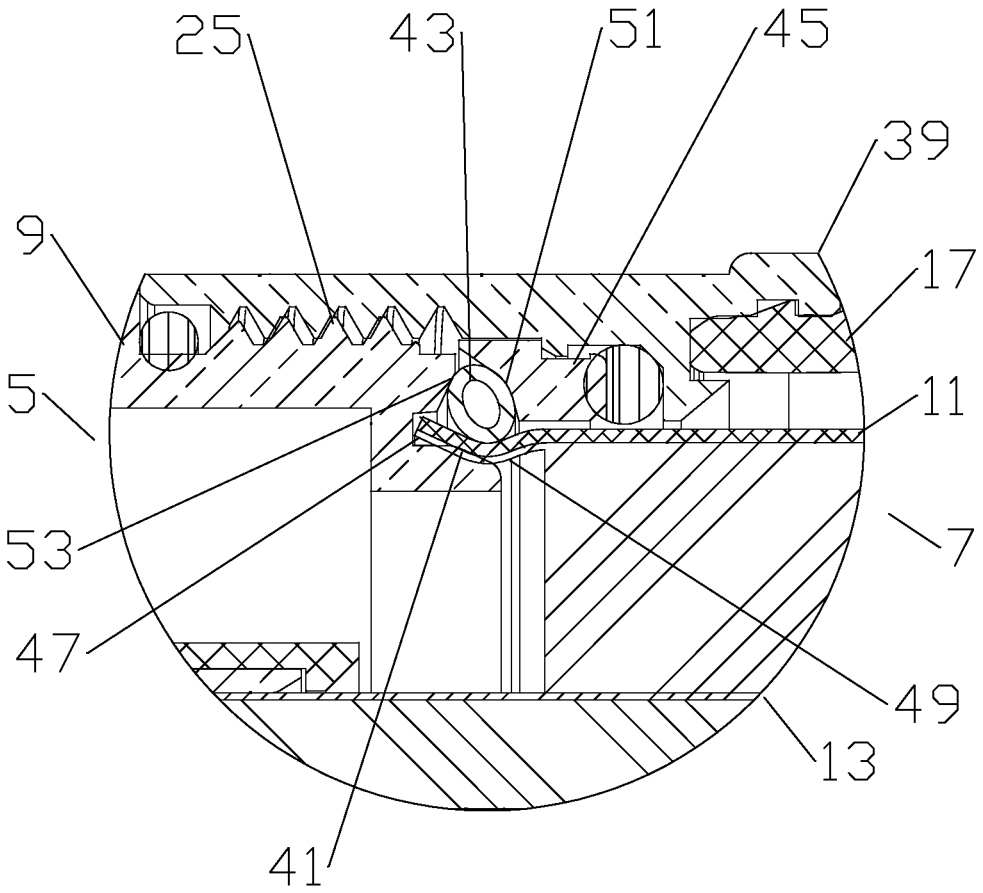
FIG. 8 is a close-up view of area C of FIG. 6, demonstrated with the coaxial connector in the interconnected configuration.
Figure 9:
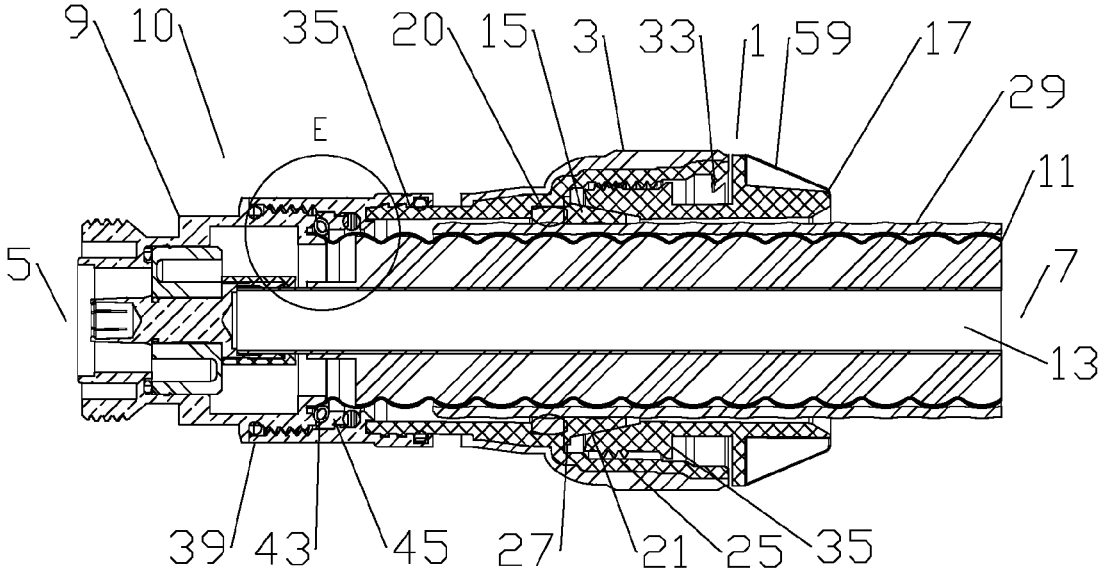
FIG. 9 is a schematic cross-section side view of the connector and stabilizing assembly of FIG. 6, demonstrated with an annular corrugated outer conductor coaxial cable in the interconnected configuration.
Figure 10:
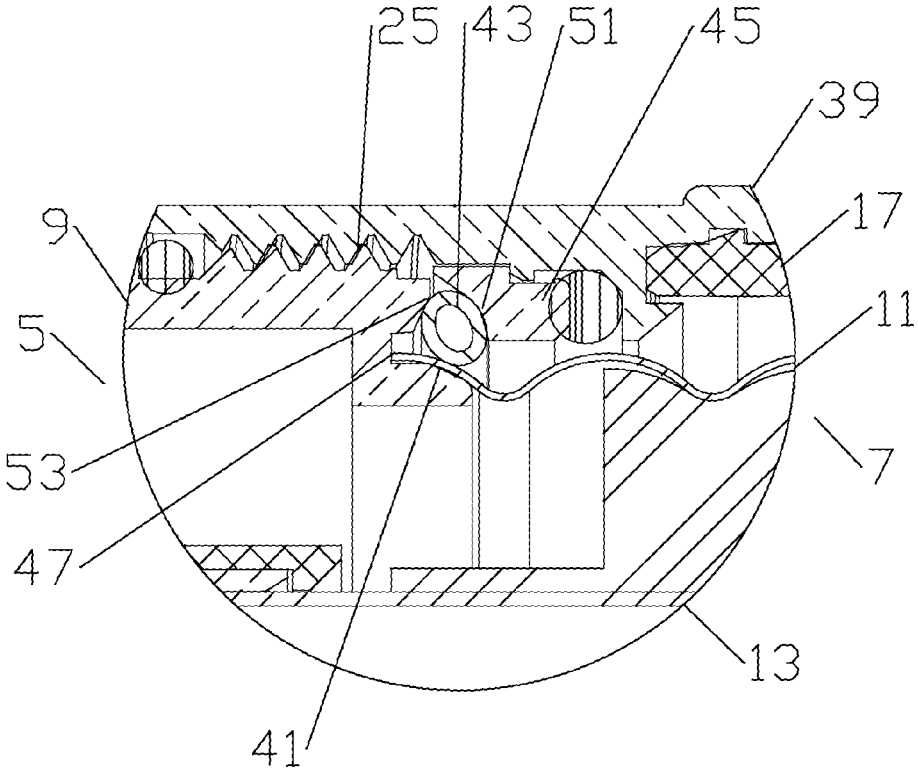
FIG. 10 is a close-up view of area E of FIG. 9.

The coaxial connector 10 of FIGS. 6-10 utilizes an outer conductor clamp-type interconnection wherein the leading edge of the outer conductor 11 of the coaxial cable 13 is clamped between a contact surface 41 and a spring contact 43 driven by a slip ring 45 and the connector coupling body 39 against the outer diameter of the outer conductor 11. As best shown in FIG. 7, the contact surface 41 is provided on the inner sidewall of an outer conductor groove 47 open to the cable end of the connector body. Because the contact surface 41 has a diameter less than the inner diameter of the outer conductor 11, the prepared end of the outer conductor 11, here demonstrated as a smooth sidewall type outer conductor 11, may be inserted through the stabilizing assembly 1 to seat within the outer conductor groove 47 without requiring the additional installation steps of flaring the leading edge of the outer conductor 11 and/or disassembly/reassembly of the coaxial connector 10. As shown in FIGS. 9 and 10, the outer conductor groove 47 is also capable of receiving the outer conductor 11 of an annular corrugated outer conductor type coaxial cable 13. Thereby, a single coaxial connector 10 configuration may be utilized with multiple types of coaxial cable 13.

Metal scrapings, scratches, chips and/or burrs generated during cable end stripping and/or connector to cable installation have been identified as another potential source of PIM. The present embodiment further reduces PIM by enabling a cable end preparation that avoids metal scrapings, scratches and/or burrs along the inner diameter of the outer conductor 11 by leaving a layer of dielectric and/or adhesive 49 along the inner diameter of the leading edge of the outer conductor 11 (see FIGS. 7 and 8) and establishing the electrical interconnection between the connector body 9 and the outer conductor 11 via the circumferential contact of the spring contact 43 around the outer diameter of the outer conductor 11. Thereby, any metal scrapings, scratches, chips and/or burrs that may arise with respect to the outer conductor 11 will only be on the outside of the coaxial cable 13.

Figure 11:
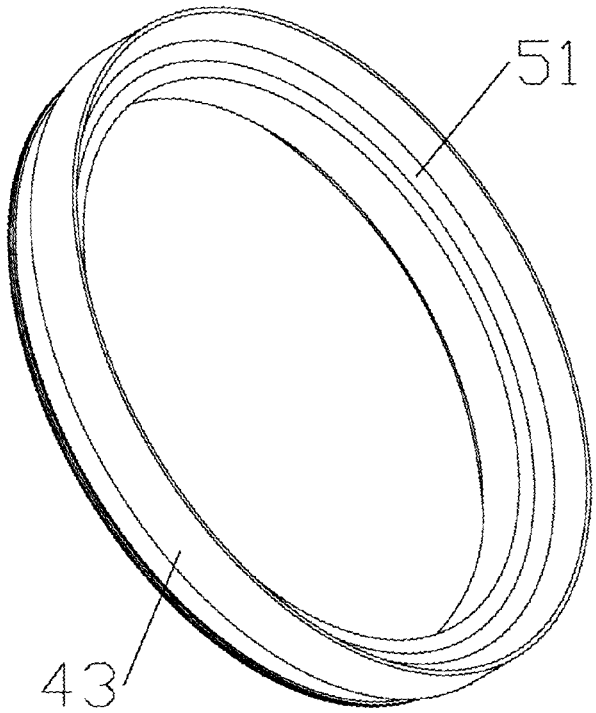
FIG. 11 is a schematic isometric view of the slip ring of the coaxial connector of FIGS. 6-10.

Another PIM factor arises from metal to metal scraping between the spring contact 43, here demonstrated as an annular coil spring, and the connector body 9 and/or outer diameter of the outer conductor 11 if the spring contact 43 rotates with the slip ring 45 as the connector coupling body 39 is rotated during tightening to obtain the electro-mechanical interconnection with the outer diameter of the outer conductor 11. To encourage the spring contact 43 to seat against the outer diameter of the outer conductor 11 and against the connector body 9 with minimal rotation, the contact area 51 between the slip ring 45 and the spring contact 43 is provided with a reduced friction surface by forming the contact area 51 of the slip ring 45 with an arc radius complementary to the dimensions of the spring contact 43 as clamping force is applied. The inventor's analysis of assembled coil springs indicates that the spring contact 43 is progressively deformed as the clamp force is applied during interconnection. Therefore, rather than forming the contact area 51 of the slip ring 45 with the spring contact 43 as an arc section of a circle, for example as shown in FIG. 11, the contact area 51 of the slip ring 45 may be provided with an oval arc section, as shown for example in FIGS. 7-10. To enable a repeatable degree of spring contact deformation, suitable for secure clamping force to retain the outer conductor 11 but short of collapsing the spring contact 43, the connector body 9 and connector coupling body 39 may be dimensioned to have a positive stop therebetween which bottoms to prevent further axial advancement of the connector coupling body 39 upon the connector body 9 at a pre-defined level of spring contact 43 compression, based upon known dimensions/deformation characteristics of the selected spring contact 43 and an expected thickness of the outer conductor 11.

In the outer conductor outer diameter current path configuration of the current embodiment, the electrical current path passes from the outer conductor 11 through the spring contact 43 to the connector body 9. Where the contact area 51 of the slip ring 45 is an oval arc section, a smooth complementary contact between the spring contact 43 and the slip ring 45 is increased, resulting in lower relative friction between these surfaces than arises between the smaller and/or sharper edge contact area 53 of the connector body 9 as the spring contact 43 is deformed during compression. That is, the contact area 51 of the slip ring 45 against the spring contact 43 (as deformed by compression) has a greater surface area than an edge contact area 53 of the connector body 9 against the spring contact 43. As the connector coupling body 39 is rotated, the slip ring 45 can rotate with respect to the spring contact 43 but the spring contact 43 will tend to be rotationally locked with respect to the higher friction, smaller edge contact area 53 of the connector body 9. Thereby, the potential for PIM generating scraping at these current path contact points during installation may be reduced.

Figure 17:
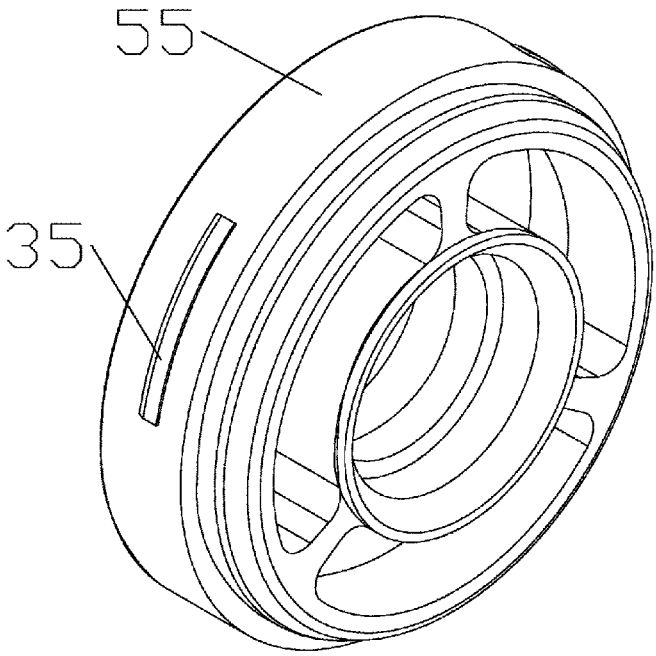
FIG. 17 is a schematic isometric view of the insulator of the coaxial connector of FIGS. 12-16.

Because the electrical current path to the connector body 9 from outer diameter of the outer conductor is via the spring contact 43, the contact area 41 supporting the inner diameter of the outer conductor 11 is not required to be a conductive surface. In a further embodiment, for example as shown in FIGS. 12-16, the contact surface 41 may be provided as a dielectric polymer insulator 55, for example as shown in FIG. 17, seated within a bore of the connector body 9. Thereby the machining requirements of the connector body 9 may be simplified by forming the outer conductor groove 47 between an outer diameter of the insulator 55 and an inner diameter of the connector body bore. The insulator 55 may be, for example, snap fit into position via retention burr(s) 35 that engage a shoulder within the bore of the connector body 9.

Figure 12:
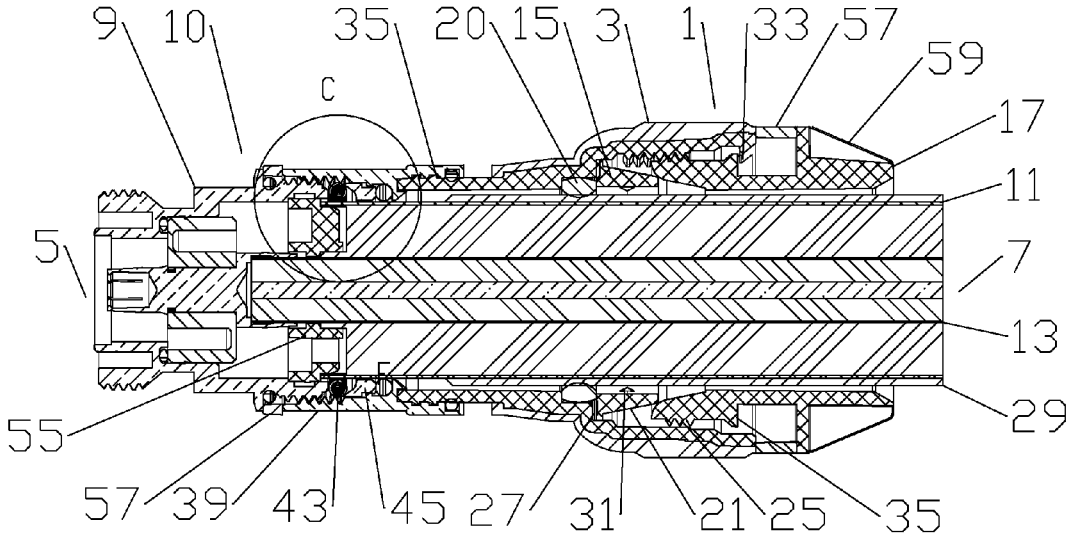
FIG. 12 is a schematic cross-section side view of the second embodiment of a stabilizing assembly mated with still another alternative coaxial connector configuration, an insertion type outer conductor leading edge radial clamp type coaxial connector with an insulator contact area, demonstrated with a smooth sidewall outer conductor coaxial cable in the coaxial cable insertion configuration.
Figure 13:
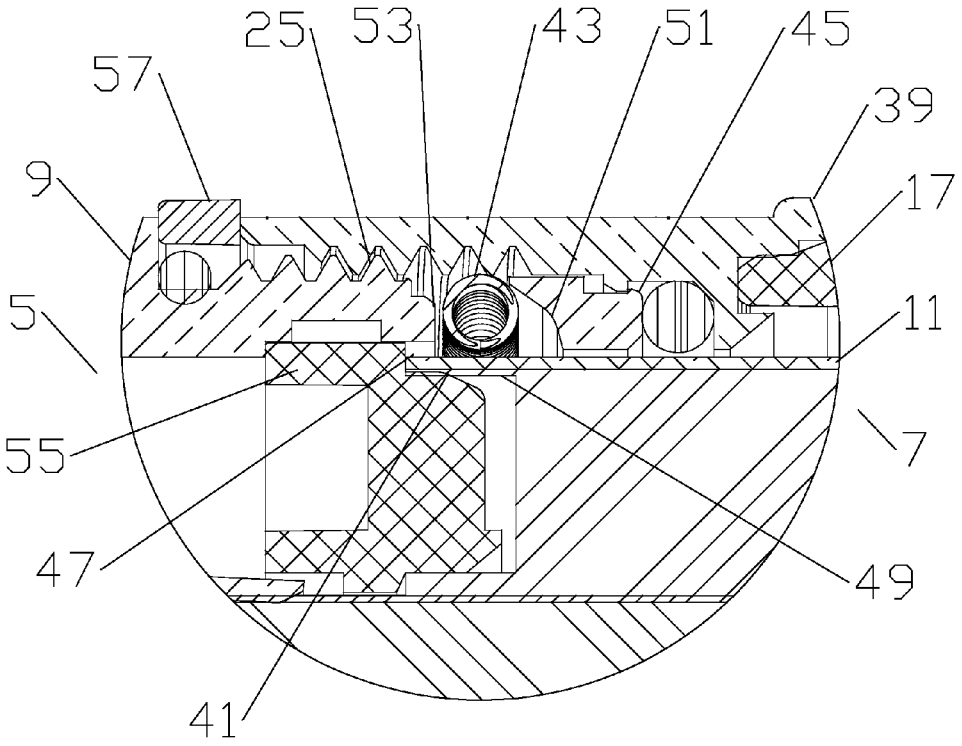
FIG. 13 is a close-up view of area C of FIG. 12.
Figure 14:
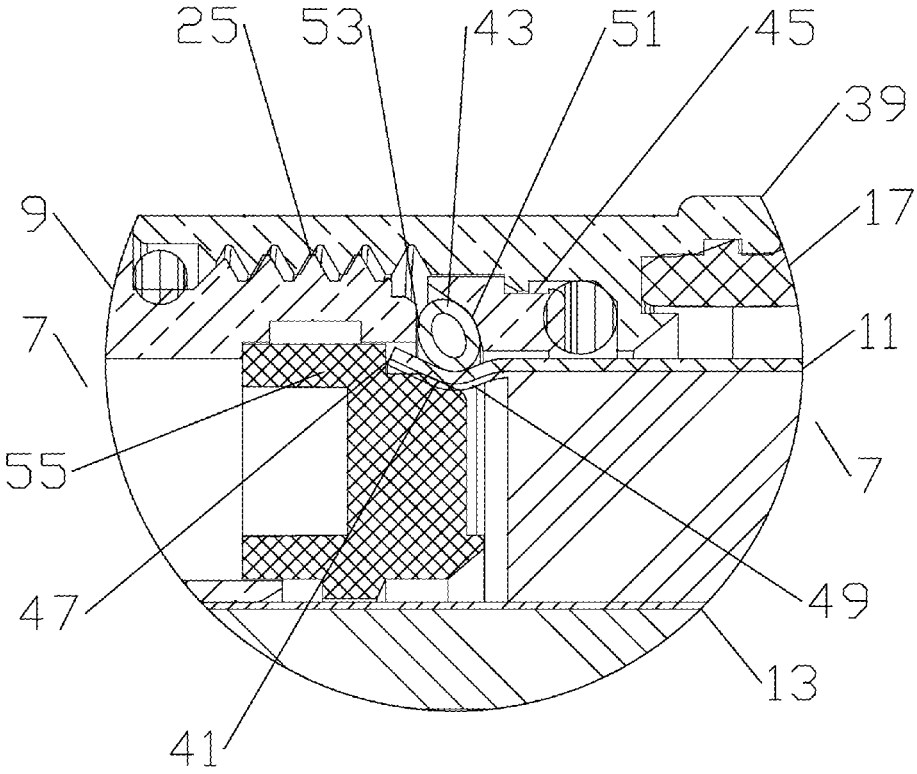
FIG. 14 is a close-up view of area C of FIG. 12, demonstrated with the coaxial connector in the interconnected configuration.
Figure 15:
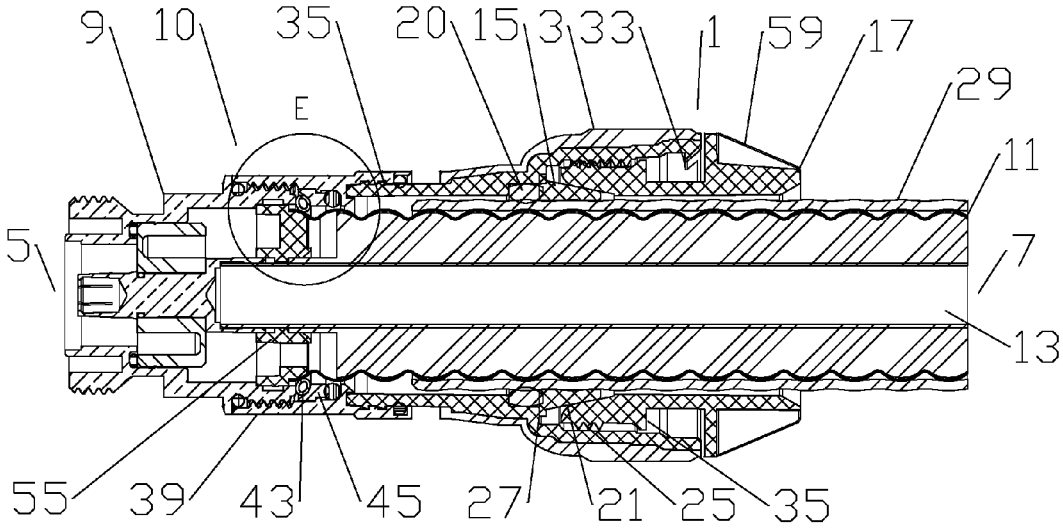
FIG. 15 is a schematic cross-section side view of the connector and stabilizing assembly of FIG. 12, demonstrated with an annular corrugated outer conductor coaxial cable in the interconnected configuration.
Figure 16:
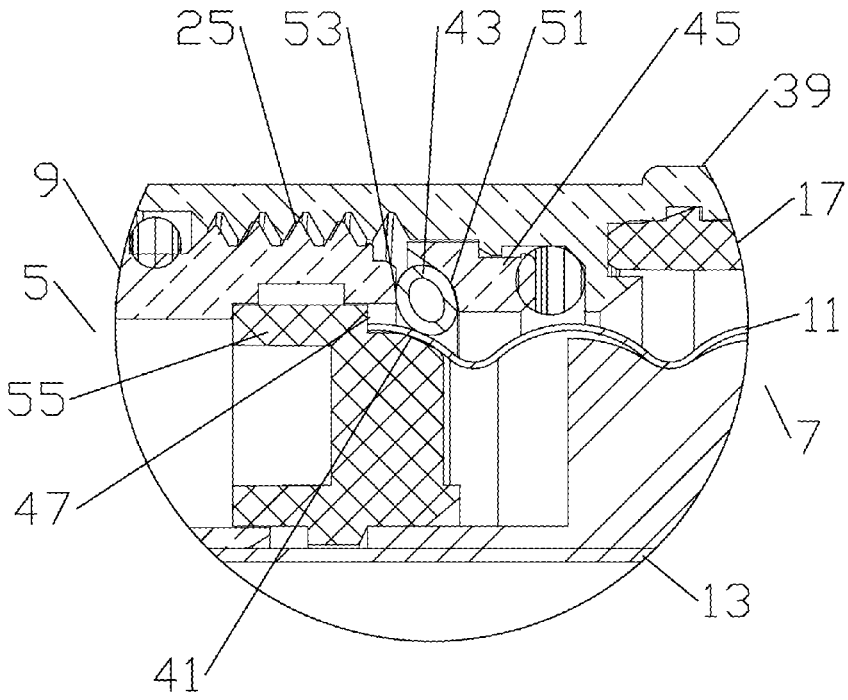
FIG. 16 is a close-up view of area E of FIG. 15.
Figure 18:
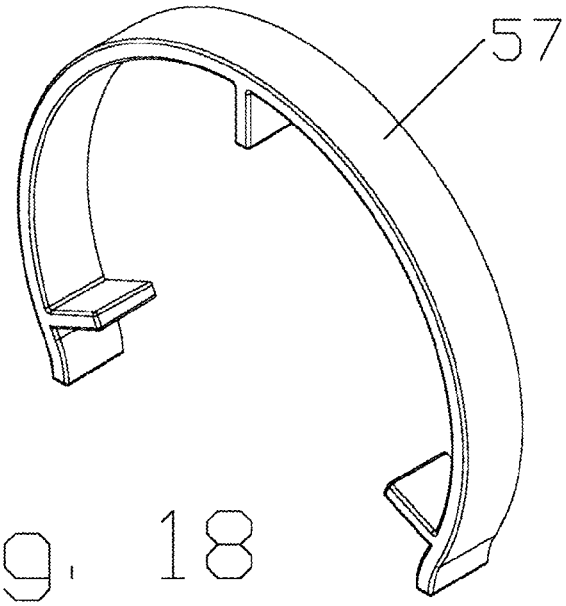
FIG. 18 is a schematic isometric view of the spacer for the stabilizing assembly of FIGS. 6 and 12.
Figure 19:
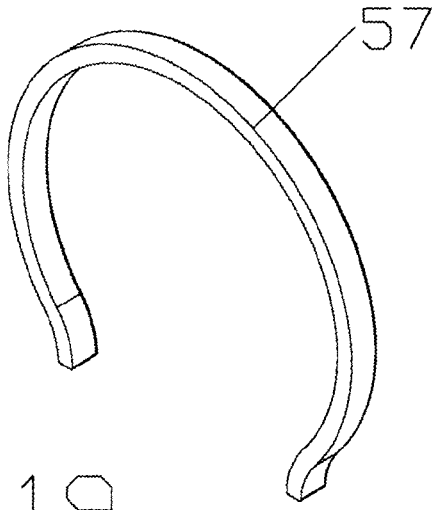
FIG. 19 is a schematic isometric view of the spacer for the coaxial connector of FIGS. 6 and 12.

For further ease of installation, as shown for example in FIGS. 6 and 12, the coaxial connector 10 and stabilizing assembly 1 may be provided ready for installation with removable outer diameter spacers 57 (best shown in FIGS. 18 and 19) between the connector body 9 and connector coupling body 39 and between the coupling body 3 and stabilizing body 17 of the stabilizing assembly 1. The spacers 57 maintain the coaxial connector 10 and stabilizing assembly 1 in a spaced apart position whereby the internal surfaces of the spring contact 43 and jacket grip 15 are retracted and/or spaced away from the path of the coaxial cable 13 and outer conductor 11 as they are inserted until the outer conductor 11 seats over the contact surface 41. Once the outer conductor 11 is seated upon the contact surface 41, the spacers 57 may be removed and discarded to allow tightening of the electromechanical and stabilizing interconnections to drive the spring contact 43 into clamping contact with the outer diameter of the outer conductor 11 and the jacket grip 15 radially inward to grip the jacket 29.

Figure 20:
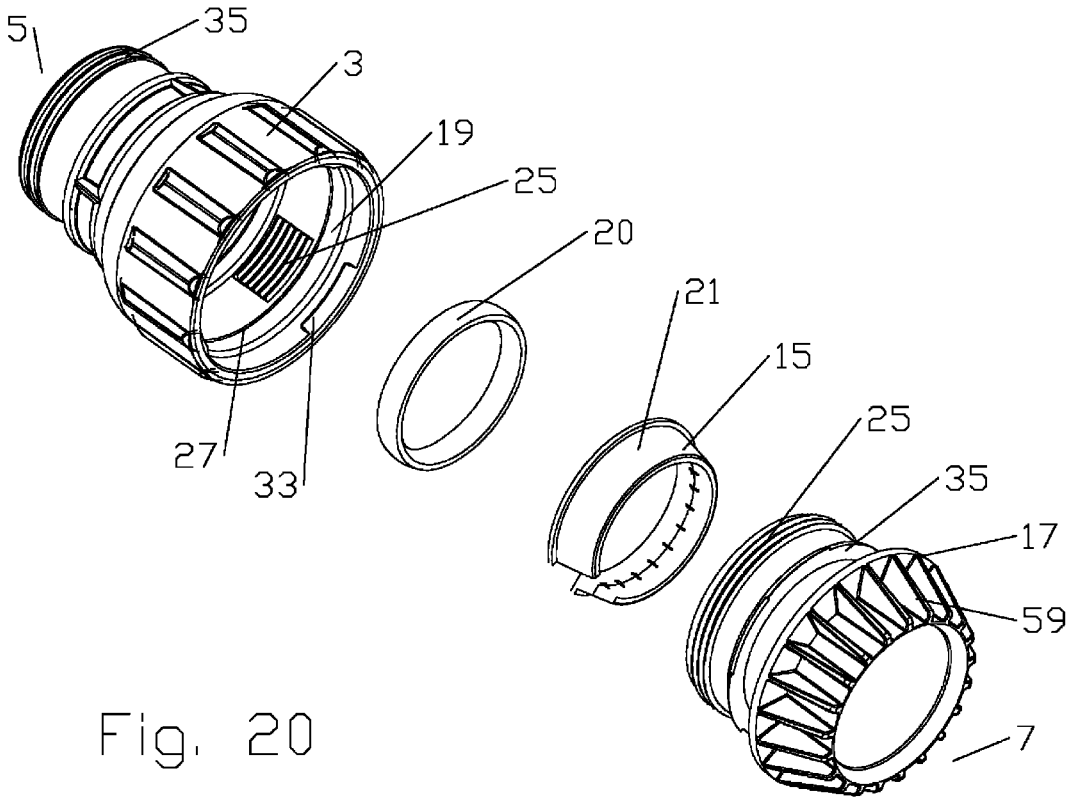
FIG. 20 is an exploded schematic isometric view of the stabilizing assembly of FIGS. 6 and 12.

FIG. 20 shows an alternative stabilizing assembly embodiment wherein the interconnection between the coupling nut 3 and connector coupling nut 39 is demonstrated as a snap fit interconnection utilizing a pair of annular retention burrs 35. The stabilizing body 17 is demonstrated with outward support fins 59 which, in addition to the previously described molding advantages of support fin(s) 37, by being reversed outward further provide additional material savings, a more streamlined appearance and a griping surface for tightening of the stabilizing body 17 into the coupling body 3.

One skilled in the art will appreciate that the stabilizing assembly 1 and several PIM reduction features of the disclosed connector arrangements enables a coaxial connector with improved electrical performance and both cost and installation efficiencies.

Table of Parts

| | |
|---|---|
| 1 | stabilizing assembly |
| 3 | coupling body |
| 5 | connector end |
| 7 | cable end |
| 9 | connector body |
| 10 | coaxial connector |
| 11 | outer conductor |
| 13 | coaxial cable |
| 15 | jacket grip |
| 17 | stabilizing body |
| 19 | angled contact surface |
| 20 | sealing gasket |
| 21 | wedge surface |
| 23 | conical contact surface |
| 25 | threads |
| 27 | shoulder |
| 29 | jacket |
| 31 | inward projecting protrusion |
| 33 | retaining lip |
| 35 | retention burr |
| 37 | support fin |
| 39 | connector coupling body |
| 41 | contact surface |
| 43 | spring contact |
| 45 | slip ring |
| 47 | outer conductor groove |
| 49 | dielectric and/or adhesive |
| 51 | contact area |
| 53 | edge contact area |
| 55 | insulator |
| 57 | spacer |
| 59 | outward support fin |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A coaxial connector for interconnection with an outer conductor of a coaxial cable, comprising:

a connector body dimensioned to couple with a connector coupling body;

a slip ring within a bore of the connector coupling body;

an annular outer conductor groove of the connector body, open to a cable end of the connector body;

a contact surface provided on an inner sidewall of the outer conductor groove;

a spring contact between the slip ring and the connector body; and a stabilizing assembly coupled to a cable end of the connector coupling body;

whereby axial advance of the connector coupling body towards the connector body drives the slip ring against the spring contact to clamp a leading edge of the outer conductor inserted into the outer conductor groove against the contact surface.

2. The connector of claim 1, wherein the stabilizing assembly comprises: a coupling body dimensioned to couple at a connector end of the coupling body with a cable end of the connector coupling body;

a jacket grip of rigid material retained between the coupling body and a stabilizing body coupled to a cable end of the coupling body;

an outer diameter of the jacket grip abutting an annular wedge surface of the stabilizing body;

the wedge surface provided with a taper between a maximum diameter proximate a connector end of the jacket grip and a minimum diameter proximate a cable end of the annular wedge surface; whereby the jacket grip is driven radially inward as the stabilizing body is advanced axially towards the coupling body.

3. The connector of claim 1, wherein the coupling of the stabilizing assembly to the connector coupling body is via a snap fit interconnection with at least one annular retention burr of the coupling body.

4. The connector of claim 1, wherein the stabilizing assembly provides a radially inward grip upon a jacket of the coaxial cable.

5. The connector of claim 1, wherein the slip ring is provided with an oval arc section contact area abutting the spring contact.

6. The connector of claim 1, wherein a contact area of the slip ring against the spring contact has a greater surface area than an edge contact area of the connector body against the spring contact.

7. The connector of claim 1, wherein the outer conductor groove is provided proximate a cable end of the connector body.

8. The connector of claim 1, wherein the outer conductor groove is provided between an outer diameter of an insulator within the bore of the connector body and an inner diameter of the bore of the connector body.

9. The connector of claim 1, further including a removable outer diameter spacer between the connector body and the connector coupling body.

10. The connector of claim 1, further including a removable outer diameter spacer between the coupling body and the stabilizing body.

11. The connector of claim 1, wherein the spring contact is biased radially outward out of an axial path between the outer conductor groove and the cable end of the connector; and the spring contact is driven radially inward by the slip ring as the connector coupling nut is advanced axially towards the connector body.

12. A method for manufacturing a coaxial connector, comprising the steps of:

providing a coaxial connector with a connector coupling body at a cable end;

providing a coupling body dimensioned to couple at a connector end of the coupling body with the cable end of the connector coupling body;

providing a jacket grip of rigid material;

providing a stabilizing body dimensioned to couple to a cable end of the coupling body;

inserting the jacket grip between the coupling body and stabilizing body and coupling the coupling body to the stabilizing body;

an outer diameter of the jacket grip abutting an annular wedge surface of the stabilizing body;

the wedge surface provided with a taper between a maximum diameter proximate a connector end of the jacket grip and a minimum diameter proximate a cable end of the annular wedge surface; whereby the jacket grip is driven radially inward as the stabilizing body is advanced axially towards the coupling body; and coupling the connector end of the coupling body to the cable end of the connector coupling body.

13. The method of claim 12, wherein the coupling between the connector coupling body and the coupling body is via snap-fit upon at least one annular retention burr of the coupling body.

14. A method for interconnecting a coaxial connector with an outer conductor of a coaxial cable, comprising the steps of:

inserting a leading edge of the outer conductor through a stabilizing assembly, a connecter coupling body and into an outer conductor groove of a connector body;

axially advancing the connector coupling body towards the connector body until a slip ring between the connector body and the connector coupling body clamps the outer conductor between a spring contact and a contact surface of the outer conductor groove; and axially advancing a stabilizing body towards a coupling body of the stabilizing assembly until a jacket grip between the stabilizing body and the coupling body is biased radially inward against a jacket of the coaxial cable.

15. The method of claim 14, further including the step of, after the outer conductor is seated in the outer conductor groove, removing a spacer from between the connector body and the coupling body and a spacer from between the stabilizing body and the coupling body.

16. The method of claim 14, wherein the spring contact is rotationally stationary with respect to the connector body as the connector coupling body is axially advanced.

17. The method of claim 14, wherein the outer conductor is one of solid smooth sidewall and solid corrugated type outer conductor.

18. The method of claim 14, wherein a contact area of the slip ring is provided as an oval arc section.

19. The method of claim 14, wherein the jacket grip is a rigid material.

20. The method of claim 14, further including a coaxial cable end preparation step wherein a portion of a dielectric material and/or adhesive is not removed from an inner diameter of the leading edge portion of the outer conductor.

* * * * *